United States Patent [19]

Treppler

[11] 4,365,832

[45] Dec. 28, 1982

[54] HOLD DOWN LATCH ASSEMBLY FOR HATCH COVERS

[75] Inventor: Marc A. Treppler, Florissant, Mo.

[73] Assignee: ACF Industries, Incorporated, New York, N.Y.

[21] Appl. No.: 229,377

[22] Filed: Jan. 29, 1981

[51] Int. Cl.[3] ..... E05C 5/00

[52] U.S. Cl. ..... 292/256.5; 105/377; 292/113; 292/259 R

[58] Field of Search ..... 292/100, 113, 161, 66, 292/247, 256.5, 259; 105/377

[56] References Cited

U.S. PATENT DOCUMENTS

| | | | |
|---|---|---|---|
| 1,815,181 | 7/1931 | Bienaime | 292/113 |
| 3,325,200 | 6/1967 | Fowler | 292/113 |
| 3,848,912 | 11/1974 | Jensen | 292/256.5 |
| 4,307,670 | 12/1981 | Nadherny | 292/256.5 X |

FOREIGN PATENT DOCUMENTS

| | | | |
|---|---|---|---|
| 93597 | 12/1938 | Sweden | 292/113 |
| 95989 | 6/1939 | Sweden | 292/113 |
| 707854 | 1/1980 | U.S.S.R. | 292/113 |

*Primary Examiner*—Thomas J. Holko

*Attorney, Agent, or Firm*—Henry W. Cummings

[57] ABSTRACT

In accordance with the present invention a hatch cover hold down arrangement is provided including a handle which pivots about a first mounting pin. The handle includes an elongated locking slot. A locking member includes an extension which in one position is located over and holds in place a hatch cover. A locking pin extends from the locking member into the elongated slot in the handle and a mounting pin slot is provided in the locking member which receives the mounting pin upon which the handle is pivotably mounted. Preferably the mounting pin is supported by a flange located adjacent to the locking member which includes a vertical surface which guides the locking member during vertical movement between open and closed positions. The locking member includes a surface which engages the flange vertical surface as the locking member is lifted by the handle and locking pin from the closed position toward open position and prevents initial rotation of the locking member. However when the handle pivot pin bottoms out in the bottom of the slot in the locking member, the pressure within the car has been relieved and the locking member moves with the handle to a position which no longer obstructs the cover.

7 Claims, 8 Drawing Figures

HOLD DOWN LATCH ASSEMBLY FOR HATCH COVERS

BACKGROUND OF THE INVENTION

U.S. Pat. No. 3,848,912 discloses a latch assembly for a railway hatch cover. A handle actuates a latch which is guided in movement between open and closed positions by a slot in a mounting flange. This concept requires an L-shaped slot in the locking member which is engaged by a protrusion in the handle.

In U.S. Pat. No. 3,325,200 a handle is rotated to rotate a locking member between engaged and disengaged positions. A stud located on the locking member extends into a slot in a U-shaped extension of the handle and rotation of the handle translates rotative movement to the locking member. The locking member pivots about a separate axis from the handle such that a given rotation of the handle results in a greater rotation of the locking member.

SUMMARY OF THE INVENTION

In accordance with the present invention a hatch cover hold down arrangement is provided including a handle which pivots about a first mounting pin. The handle includes an elongated locking slot. A locking member includes an extension which in one position is located over and holds in place a hatch cover. A locking pin extends from the locking member into the elongated slot in the handle and a mounting pin slot is provided in the locking member which receives the mounting pin upon which the handle is pivotably mounted. Preferably the mounting pin is supported by a flange located adjacent to the locking member which includes a vertical surface which guides the locking member during vertical movement between open and closed positions. The locking member includes a surface which engages the flange vertical surface as the locking member is lifted by the handle and locking pin from the closed position toward open position and prevents initial rotation of the locking member. However when the handle pivot pin bottoms out in the bottom of the slot in the locking member, the pressure within the car has been relieved and the locking member moves with the handle to a position which no longer obstructs the cover. After the cover is closed the operation is reversed to hold the cover in closed position.

IN THE DRAWINGS

DESCRIPTION OF PREFERRED EMBODIMENTS

Figure 1:
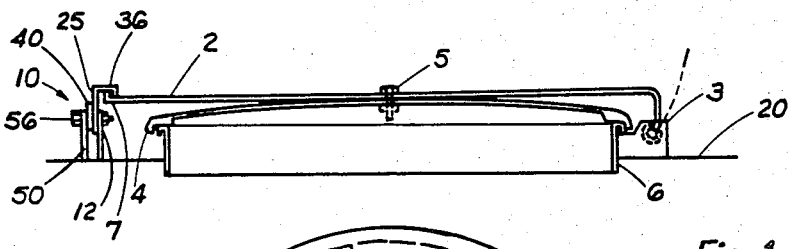
FIG. 1 is a sectional view of a strap hatch cover and the latch assembly of the present invention looking in the direction of the arrows along the line 1—1 in FIG. 2.
Figure 2:
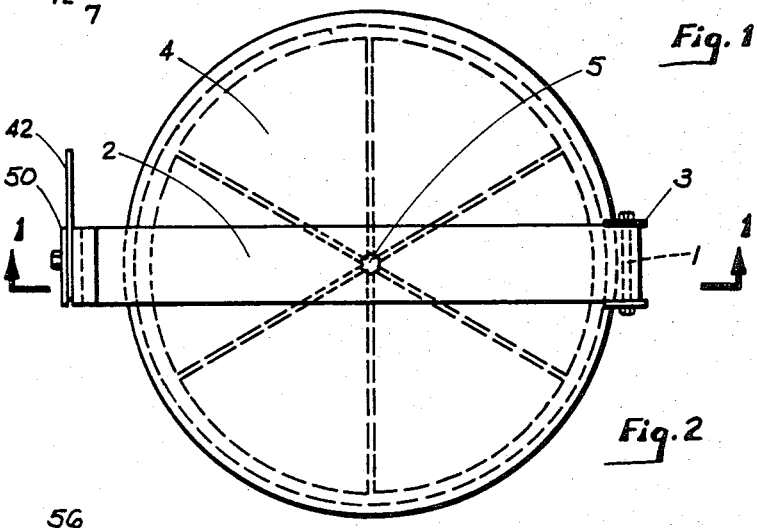
FIG. 2 is a plan view of the strip, hatch cover and latch assembly.
Figure 3:
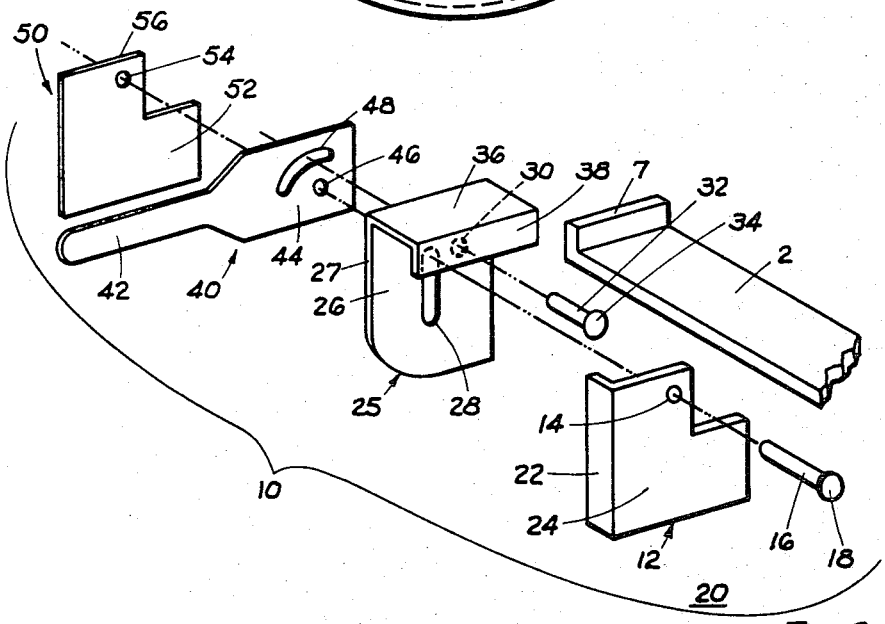
FIG. 3 is an exploded perspective view of the latch assembly of the present invention in the closed position.

In the drawings a hatch cover strap 2 is mounted upon a pin 1 extending through bracket 3 which is mounted on the car roof 20. The strap 2 is connected to a hatch cover 4 with a stud 5, which in closed position engages a hatch ring 6. The strap includes an upper extending lip 7.

In accordance with the present invention a hatch cover latch assembly 10 includes a flange support 12 including an opening 14 which receives a pivot pin 16 having a head thereon 18. Flange support 12 is mounted on the roof of a railway car 20 and includes a vertical guiding surface 22 approximately perpendicular to the wall 24.

Pin 16 extends through a locking latch 25 including an elongated pivot pin slot 28 which receives the pin 16, and an opening 30 which receives a latch pin 32 having a head thereon 34 which abuts the latch body portion 26. Latch 25 includes a substantially horizontal top surface 36 and a downwardly extending vertical surface 38 adapted to engage the hatch cover strap 2.

A handle 40 includes an elongated gripping portion 42 and a body portion 44. Body portion 44 includes a pivot pin opening 46 to receive the pivot pin 16 and an elongated latch slot 48 to receive the latch pin 32. It will be apparent that handle 40 is pivotably mounted about the pin 16.

A flange support 50 includes a vertical wall 52 having an opening 54 to receive the pivot pin 16. A cotter 56 maintains the pin in place pivotably mounting the handle about the pin 16. Support 50 is also welded to the car roof 20.

Figure 4:
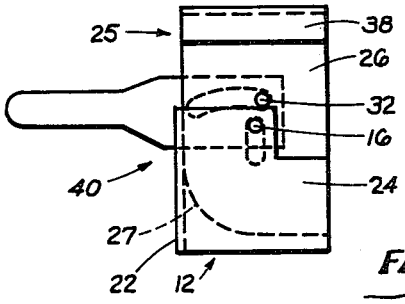
FIG. 4 is a side elevation view of the latch assembly in the closed position.
Figure 5:
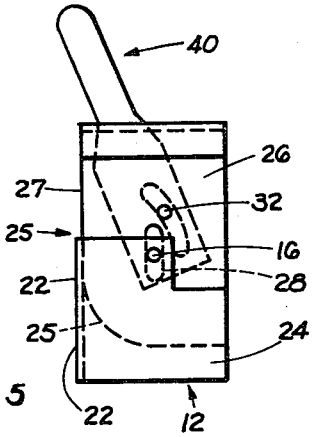
FIG. 5 is a view of the assembly after the handle has been rotated to move the locking member partially between open and closed positions.

FIGS. 1 and 4 show the assembly 10 with the latch 25 in the closed overcenter position overlying the hatch cover strap 2, engaging the lip 7. In order to open the hatch cover the handle 40 is first rotated in the clockwise direction as shown in FIG. 5. The handle is pivoted about the pin 16. This movement of the handle lifts the latch 25 by means of the pin 32. During this time, the surface 27 of the locking latch engages the vertical surface 22 of the flange 12 to prevent rotation of the locking member 25. FIG. 5 shows that the locking latch 25 has lifted relative to the pivot pin 16 along the pivot pin slot 28.

Figure 6:
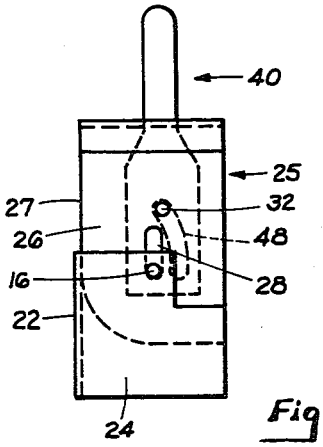
FIG. 6 is a view of the locking member assembly when the handle has been rotated approximately 90° and the handle pivot pin has bottom out in the bottom of the slot in the locking member. The locking member is now in its full vertical position.
Figure 7:
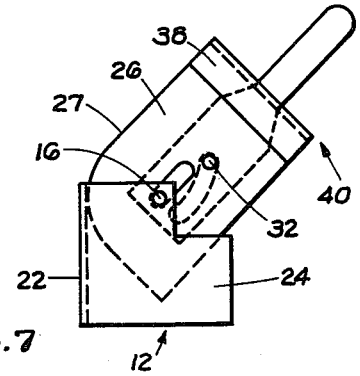
FIG. 7 is a view after the handle has been rotated sufficiently that the locking member will be rotated with the handle.

FIG. 6 shows the position of the handle and the latch when the latch pin 32 has reached the end of the latch slot 48 in the handle and the locking latch has reached the end of the pivot pin slot 28. Any pressure in the tank will then be relieved without the cover flying open and thus presenting a danger to the operator. It will be apparent that further rotation of the handle will cause the handle 40 and the latch 25 to rotate together clockwise as shown in FIG. 7, to the position shown in FIG. 8. At this position the hatch strap 2 is no longer obstructed and can be moved to open position.

Figure 8:
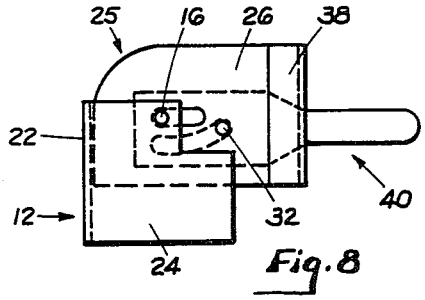
FIG. 8 is a view of the latch assembly in the full open position.

After closing the hatch cover, in order to again move the latch assembly 10 to closed overcenter position, the handle 40 is rotated from the position shown in FIG. 8 through the position shown in FIG. 7 with the surface 27 not engaging the flange wall 22 until the position whon in FIG. 6, wherein the latch stops rotating because the flange wall 22 engages the vertical portion of surface 27 preventing further rotation. As illustrated in FIG. 5, the latch then moves vertically downward through further rotation of handle 40 to the closed, overcenter position shown in FIG. 4, wherein top surface 36 and vertical surface 38 again engage strap 2 and lip 7.

What is claimed is:

1. A hatch cover latch assembly comprising: a handle pivotably mounted about a mounting pin; said handle including an elongated latch slot; a locking member including an extension which in one position is located over and holds in place a hatch cover; a latch pin extending from said locking member into said elongated latch slot in the handle; a mounting pin slot provided in said locking member which receives said mounting pin; said mounting pin supported by a flange located adjacent to said latch which includes a flange surface which guides said locking member during vertical movement between open and closed positions; said locking member including a latch surface which engages said flange surface as the locking member is lifted by said handle and said latch pin from the closed position toward open position and prevents rotation of the locking member during such vertical movement, whereby when said handle pivot pin bottoms out in the bottom of said locking member mounting pin slot, said locking member rotates with said handle to a position which no longer obstructs the cover, whereby said cover may be opened; and whereby said locking member may be returned to a closed, engaged position by rotation of said handle in the opposite direction whereby said locking member moves with said handle until said latch surface engages said flange surface whereby said locking member descends vertically to a closed, engaged position with said cover.

2. A hatch cover latch arrangement according to claim 1, wherein a second mounting flange is provided laterally spaced from said first recited flange which also supports said handle pivot pin.

3. A hatch cover latch arrangement according to claim 2, wherein both of said flanges are mounted upon a railway hopper car.

4. A hatch cover latch arrangement according to claim 1 wherein a lip is provided on the hatch cover.

5. A hatch cover latch assembly according to claim 1, wherein in closed position said mounting pin slot is elongated vertically.

6. A hatch cover latch assembly according to claim 5, wherein in closed position said elongated latch slot is elongated in the horizontal direction.

7. A hatch cover latch assembly according to claim 6, wherein said elongated latch slot is at least partially arcuate.

* * * * *

UNITED STATES PATENT AND TRADEMARK OFFICE

CERTIFICATE OF CORRECTION

PATENT NO. : 4,365,832

DATED : December 28, 1982

INVENTOR(S) : Marc A. Treppler

It is certified that error appears in the above-identified patent and that said Letters Patent are hereby corrected as shown below:

In column 1, line 55, please change "strip" to --strap--.

In column 2, line 69, please change "whon" to --shown--.

Signed and Sealed this

*Thirty-first* Day of *May 1983*

[SEAL]

*Attest:*

DONALD J. QUIGG

*Attesting Officer*

*Acting Commissioner of Patents and Trademarks*